United States Patent [19]

Carvalho

[11] 4,074,247

[45] Feb. 14, 1978

[54] ATTACK DOG SECURITY SYSTEM

[76] Inventor: Ronald M. Carvalho, Box 175, Groton St., Dunstable, Mass. 01827

[21] Appl. No.: 760,094

[22] Filed: Jan. 17, 1977

[51] Int. Cl.[2] ..... G08B 13/00

[52] U.S. Cl. ..... 340/276; 340/222; 119/112

[58] Field of Search ..... 119/19, 112, 114, 115, 119/15.5; 340/222, 276, 279, 290

[56] References Cited

U.S. PATENT DOCUMENTS

| | | | |
|---|---|---|---|
| 593,844 | 11/1897 | Haegelin | 119/112 |
| 1,449,954 | 3/1923 | Radoush | 119/112 |

*Primary Examiner*—Glen R. Swann, III

*Attorney, Agent, or Firm*—Pearson & Pearson

[57] ABSTRACT

A burglar alarm system includes an attack dog and is adapted for use in premises having valuable furnishings subject to damage when the dog becomes excited or incontinent. The system includes a dog kennel in the premises and auditory alarms in various zones which are distinguishable from each other by the dog. When an intruder is sensed by the circuit, one of the alarms sounds, the door of the kennel is unlatched and the dog dashes to the zone recognized. A locked box switch outside the premises is openable by firemen to open the circuit.

6 Claims, 4 Drawing Figures

ATTACK DOG SECURITY SYSTEM

BACKGROUND OF THE INVENTION

Attack dogs have been much used in premises, closed at night, to freely roam from room to room and instantly rush to the sound of any intrusion. However most attack dogs can only remain continent for about four hours, when not confined in a kennel. In addition, most attack dogs become unduly excited when an intrusion is sensed, jumping up on furniture, rushing headlong past furniture and over rugs and otherwise are not usable in luxurious clubs, or similar premises having costly fragile furnishings, valuable floor and wall coverings, statuary or the like.

It has heretofore been proposed in U.S. Pat. No. 3,063,412 to Colsher of Nov. 13, 1962 to confine game birds in a wire cage in a corn shook out in the field and to release the birds by electric wire connection to a hidden enclosure. Such a release system however is manually operated rather than automatic, the released birds fly in all directions and an operator is continually required to select which cage will be unlatched and when.

Burglar alarm systems are well known as exemplified in U.S. Pat. No. 3,787,832 to Bolinger of Jan. 22, 1974 wherein a time delay is incorporated to permit an inside switch to be closed to arm the circuit and yet give the operator time to exit from an outside door. An alarm circuit which includes the radiation of a signal, or beam, which will be broken by an intruder to sound an alarm is disclosed in U.S. Pat. No. 3,828,336 to Massa of Aug. 6, 1974.

The system of this invention can be used with any burglar alarm circuit to automatically control the actions of an attack dog in a luxurious environment.

SUMMARY OF THIS INVENTION

In this invention, such luxurious premises still have the benefit of the presence of an attack dog, but the dog is normally confined in a kennel set up centrally of the inside of the building. Thus the dog can remain continent in his own kennel for twelve to sixteen hours and does not roam the rooms damaging the furnishings each time he becomes excited. The premises are divided into at least two zones each with its own auditory alarm, recognizable by the dog, so that when released the dog aims directly for the zone intruded.

The dog is confined in a wire cage kennel with an electrically unlatched closure. Thus, when an intruder is sensed by the burglar alarm circuit in a particular zone, the auditory alarm is sounded in that zone, the kennel closure is opened to release the dog and the police station is notified all simultaneously.

DESCRIPTION OF A PREFERRED EMBODIMENT

Figure 1:
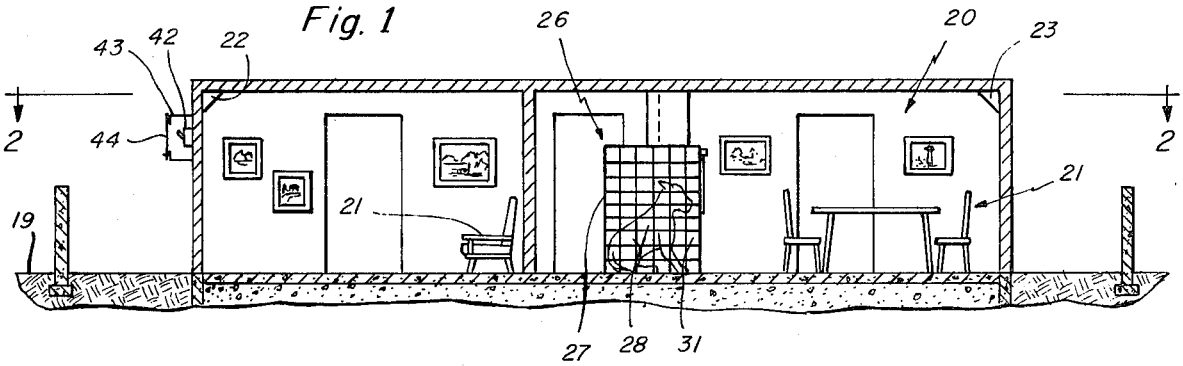
FIG. 1 is a schematic side elevation and FIG. 2 is a corresponding plan view of a typical building with the kennel of the invention installed therein.

As shown in the drawing, the building 20 is typical of the clubhouse of a country club, the plush offices of a manufacturing plant, a museum, or the like. It is equipped with costly, fragile furniture, furnishings, rugs, paintings as indicated at 21.

The building 20 and its outer premises 19, are divided into at least two zones A and B and preferably into four zones A, B, C and D. The zones are established in any convenient manner which will permit each zone to have an auditory alarm 22, 23, 24 or 25, such as an electric bell or buzzer. Each alarm is of a high frequency, audible or recognizable by human beings, but which is easily distinguished by the superior hearing of an attack dog.

The attack dog security system 26 of the invention includes a portable kennel 27, with which the attack dog 28 is familiar and which is easily set up centrally of the building 20 as at 29, in a position where the dog 28 can hear each of the alarms 22, 23, 24 or 25. The kennel 27 includes a guillotine type door closure 32, which is normally held closed by a latch 33. Electrically operated unlatching means 34 is provided such as a solenoid and coil, so that when energized the door 32 is enabled to fall by gravity and release the attack dog 28.

Because the attack dog 28 is confined in his own familiar kennel, he is able to remain continent for the ten to fifteen hours in which the building 20 may be closed for example from 6 P.M. to 8 A.M. the next day. If he were permitted to run free through the building, it has been found by dog handlers that he may become incontinent after four hours, thereby damaging the premises. It will also be seen that if the attack dog becomes excited by some extraneous noise such as the barking of another dog in the distance, or the headlights of a vehicle shining through the windows, he will be confined in the kennel rather than jumping on the furniture, chewing the draperies or causing other damage sometimes inflicted by canines.

The security system 26 may be of any well known type such as described in the above mentioned patents, but preferably comprises an electric alarm circuit 35, including a suitable source of electricity 36, the auditory alarms 22, 23, 24 and 25, the unlatching means 34 and intruder-sensing means in the form of pressure switches under the rugs in each room as at 37, 38, 39 and 41.

The circuit 35 is so arranged that the closing of an intruder sensing switch such as 37, in a zone such as A closes a circuit from the source 36 to the auditory alarm 22, to sound the frequency recognized by the dog 28, while simultaneously opening the door 32 to release the dog to attack the intruder.

Figure 2:
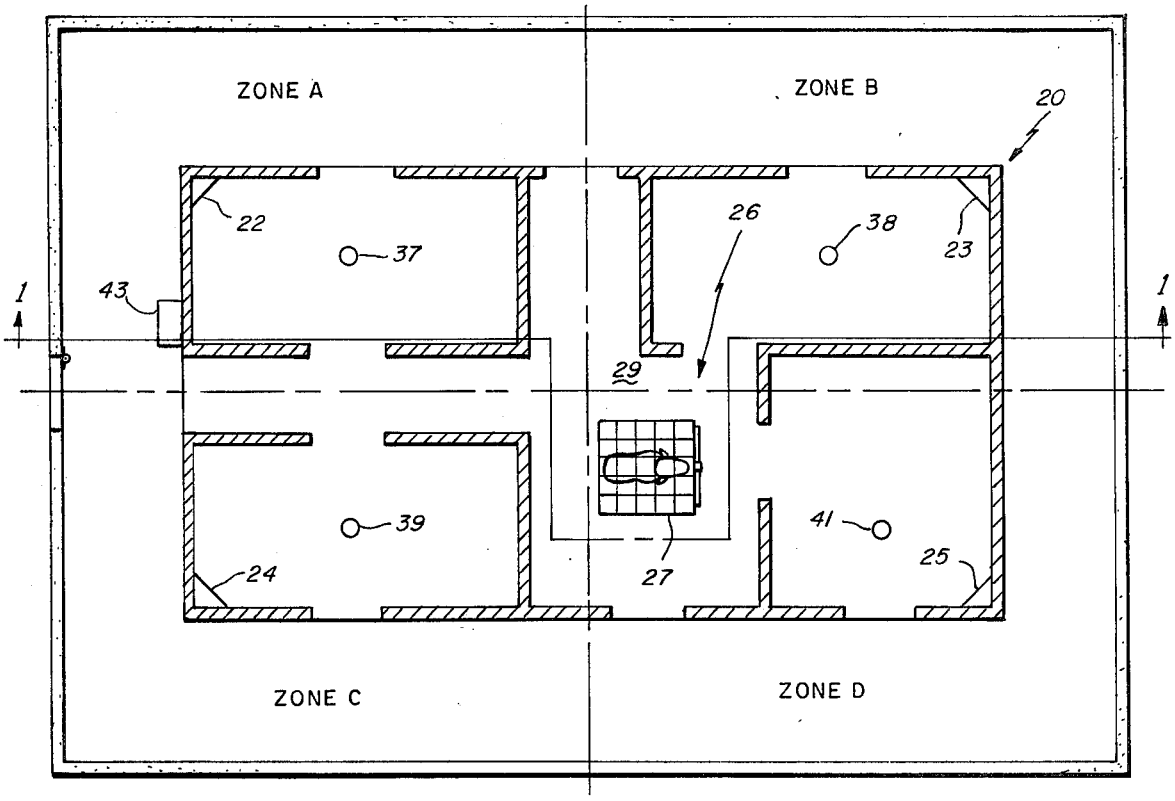
Figure 3:
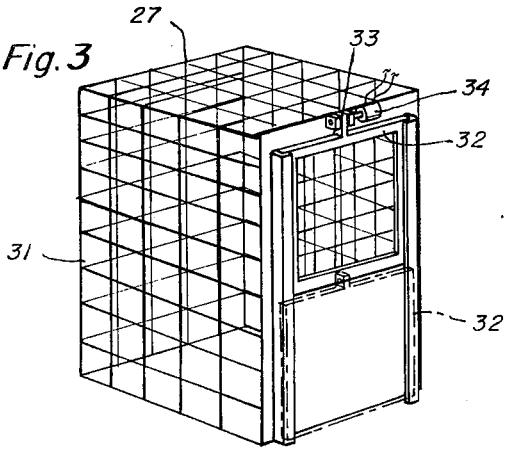
FIG. 3 is an enlarged perspective view of the kennel.
Figure 4:
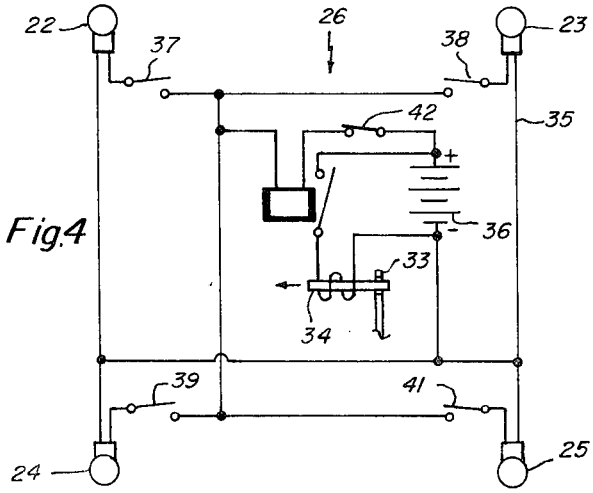
FIG. 4 is a schematic diagram of a simplified electric circuit of the invention.

In the event of a fire, the system 26 includes a dearming control switch 42 in the circuit 35 and illustrated diagrammatically in FIG. 2, the switch being normally closed and contained in a box 43 having a removable cover 44 openable by a key in the possession of the fire, or police department of the area. Thus the alarm circuit can be opened, to permit firemen to enter the premises without triggering the alarm and releasing the dog and the dog can be bodily transported in his kennel out of the building.

The normally open electric alarm circuit 35, is intended only to be exemplary of one type alarm circuit and it will be understood that the actual circuit may be one of the more sophisticated closed circuits, with the components held open by suitable relays whereby any interference with the circuit such as the severing of the conductors, cutting off the source, etc. will actuate the alarm and notify the police.

I claim:

1. In combination with a building having valuable furniture and furnishings and divided into at least two zones, or areas;

an attack dog security system comprising:

an attack dog kennel, located within said building, said kennel having a normally latched door for confining an attack dog in said kennel and having electrically operated means for unlatching said door and releasing said dog from said kennel; and electric burglar alarm circuit means including a source of electricity, said electrically operated means; alarm means and sensing means, said circuit activating the alarm of said alarm means and activating said electrically operated door unlatching means upon sensing an intruder in said building.

2. A combination as specified in claim 1 wherein:

each said zone includes an auditory alarm at a frequency inaudible to humans but recognizable by an attack dog;

whereby an attack dog released from said kennel is guided to the threatened zone of said building by the alarm in that zone.

3. A combination as specified in claim 1 wherein:

said electric alarm circuit means includes a normally closed switch outside said building, usable by fireman to open said circuit and thereby prevent undesired release of said attack dog in case of fire in said building.

4. A combination as specified in claim 3 plus:

a switch box, enclosing said switch and having a cover;

and a lock, locking said cover until unlocked by said firemen.

5. In combination a building an electric burglar alarm system, adapted to sense the presence of an intruder and to actuate an auditory alarm;

an attack dog kennel within said building, said kennel having a normally closed door for confining an attack dog therein;

and electrically actuated latch means, connected into the circuit of said alarm system, and arranged to open said door to release said dog when said alarm system senses an intruder in said building.

6. In combination with a building having valuable furniture and furnishing and divided into at least two zones;

an attack dog security system comprising;

an attack dog enclosure located within said building, said enclosure having a normally latched door for confining an attack dog in said enclosure and having electrically operated means for unlatching said door to release said dog from said enclosure;

at least two auditory alarms, one in each said zone sounding at a frequency recognizable by an attack dog;

a plurality of intruder sensing switch means, located at selected positions in and around said premises, one in each said zone;

an electric burglar alarm circuit means including a source of electricity, said means for unlatching said door, the intruder sensing switch means in each said zone and the electric auditory alarm in said zone;

the actuation of a sensing switch in one of said zones causing the release of said attack dog from said enclosure and the sounding of the auditory alarm of said zone to direct the dog to said zone.

* * * * *